US007189685B2

(12) United States Patent
Hubig et al.

(10) Patent No.: US 7,189,685 B2
(45) Date of Patent: Mar. 13, 2007

(54) METHOD AND COMPOSITION FOR REMOVING HYDROPHOBIC SOIL

(75) Inventors: Stephan Maria Hubig, Maplewood, MN (US); Robert D. P. Hei, Baldwin, WI (US); Terry J. Klos, Victoria, MN (US)

(73) Assignee: Ecclab Inc., St. Paul, MN (US)

( * ) Notice: Subject to any disclaimer, the term of this patent is extended or adjusted under 35 U.S.C. 154(b) by 0 days.

(21) Appl. No.: 10/897,598

(22) Filed: Jul. 23, 2004

(65) Prior Publication Data

US 2006/0019863 A1 Jan. 26, 2006

(51) Int. Cl.

| | |
|---|---|
| ***C11D 1/62*** | (2006.01) |
| ***C11D 1/75*** | (2006.01) |
| ***C11D 3/26*** | (2006.01) |
| ***C11D 3/30*** | (2006.01) |

(52) U.S. Cl. ..... 510/283; 510/302; 510/303; 510/350; 510/356; 510/360; 510/503; 510/504; 8/111; 8/137

(58) Field of Classification Search ..... 510/283, 510/302, 303, 350, 356, 360, 503, 504; 8/111, 8/137

See application file for complete search history.

(56) References Cited

U.S. PATENT DOCUMENTS

| | | | | |
|---|---|---|---|---|
| 4,789,496 | A | 12/1988 | Broze et al. | |
| 5,441,541 | A | 8/1995 | Mehreteab et al. | |
| 5,597,790 | A * | 1/1997 | Thoen | 510/303 |
| 5,935,271 | A * | 8/1999 | Lappas et al. | 8/137 |
| 6,087,312 | A * | 7/2000 | Masotti et al. | 510/309 |
| 6,180,592 | B1 | 1/2001 | Smith et al. | |
| 6,432,897 | B1 | 8/2002 | Cable | |
| 6,448,214 | B1 * | 9/2002 | Del Duca et al. | 510/372 |
| 6,489,281 | B1 | 12/2002 | Smith et al. | |
| 2001/0014658 | A1 | 8/2001 | Smith et al. | |

OTHER PUBLICATIONS

Sopheon/Teltech Search Report, "Soil Removal in a Pre-Treatment Process for Laundry", dated Aug. 12, 2003.

"Sandopan DTC Paste" brochure (Dec. 30, 2002).

"Household Institutional & Industrial Cleaners" brochure, http:/surface.akzonobelusa.com (Jan. 2, 2003).

"Liquid Detergents for Textiles" brochure (Jan. 2, 2003).

"Building a Cleaner" brochure (Jan. 2, 2003).

* cited by examiner

*Primary Examiner*—Gregory R. Del Cotto
(74) *Attorney, Agent, or Firm*—Merchant & Gould P.C.

(57) ABSTRACT

The present invention relates to methods and compositions for removing hydrophobic soils from textiles. The methods include contacting a soiled textile with a penetrant composition and then washing the textile. The present compositions include penetrant compositions that can also include wetting agent and hydrotrope.

12 Claims, No Drawings

METHOD AND COMPOSITION FOR REMOVING HYDROPHOBIC SOIL

FIELD OF THE INVENTION

The present invention relates to methods and compositions for removing hydrophobic soils from textiles. The methods include contacting a soiled textile with a penetrant composition and then washing the textile. The present compositions include penetrant compositions that can also include wetting agent and hydrotrope.

BACKGROUND OF THE INVENTION

Removing stains or tough soils, particularly hydrophobic soils, typically requires a separate, manual pre-treating or pre-spotting step before machine washing of textiles. Such pre-treating or pre-spotting requires inspection of each textile and application of a pre-treating or pre-spotting composition to a soiled area of the textile. There remains a need for textile cleaning compositions that remove stains or tough soils without a separate, manual pre-treating or pre-spotting step.

SUMMARY OF THE INVENTION

The present invention relates to methods and compositions for removing hydrophobic soils from textiles. The methods include contacting a soiled textile with a penetrant composition and then washing the textile. The present compositions include penetrant compositions that can also include wetting agent and hydrotrope.

The present invention relates to a method for removing soil from a textile. This method can include contacting the soiled textile with a penetrant composition; washing the penetrant treated textile with a textile cleaning composition; and removing soil from the textile. In an embodiment, the method includes contacting with a penetrant composition including alkyl amine oxide and quaternary ammonium compound. In an embodiment, the method includes contacting with a penetrant composition including nonionic surfactant and quaternary ammonium compound.

The present invention relates to a penetrant composition. The penetrant composition includes as significant soil removing ingredients alkyl amine oxide, nonionic surfactant, quaternary ammonium compound, linear or aromatic alcohol ethoxylates, or mixture thereof. In an embodiment, the penetrant composition includes as significant soil removing ingredients alkyl amine oxide and quaternary ammonium compound. In an embodiment, the penetrant composition includes as significant soil removing ingredients nonionic surfactant and quaternary ammonium compound.

DETAILED DESCRIPTION OF THE INVENTION

Definitions

As used herein, the phrase "penetrant composition" refers to any of a variety of compositions that effectively penetrate hydrophobic (e.g., oily or greasy) soil. Penetrant compositions can include one or more penetrants, one or more wetting agents, one or more hydrotropes, or mixtures thereof. As used herein, the term "penetrant" refers to an agent or mixture of agents that, in cold water (e.g., water at 50–80° F.), penetrates hydrophobic soil, thus facilitating subsequent removal of the soil by a cleaning agent. The penetrant in the penetrant composition effectively penetrates hydrophobic soil in a time suitable for cleaning a textile. The wetting agent and/or hydrotropes in a penetrant composition are effective to emulsify hydrophobic and/or nonionic components of the soil and/or composition in an aqueous medium.

As used herein, the phrase "laundry item" refers to an item made from or including textile, woven fabric, nonwoven fabric, or knitted fabrics. The laundry item can include fibers such as cotton fibers, polyester fibers, polyamide fibers such as nylon, acrylic fibers, acetate fibers, and blends thereof including cotton and polyester blends.

As used herein, the phrase "consisting essentially of" refers to a penetrant composition including listed ingredients such as the penetrant, wetting agent, hydrotrope, defoamer, and/or aesthetic enhancing agents, but excluding additional ingredients or forms of ingredients found in laundry detergents and/or bleaching compositions. For example, the penetrant composition does not include all of the ingredients found in a laundry detergent and/or bleaching composition.

Method

The present invention includes methods and compositions for removing hydrophobic (e.g., oily and/or greasy) soil from textiles. The methods include contacting a soiled textile with a penetrant composition and then cleaning the soiled textile. Contacting with penetrant occurs, for example, before contacting the textile with a sudsing cleaner.

The present contacting with penetrant composition occurs as part of the machine cleaning process and within the cleaning machine. According to the present invention, contacting with penetrant composition does not occur as an added manual step before the machine cleaning process (pre-spotting). For example, the present method can include contacting a laundry item in a laundry machine with the penetrant composition in the form of an aqueous presoak, preflush, prewash, or other step prior to the cleaning step. A preferred laundry process employs a washer/extractor.

Laundry cleaning processes can include processes such as flushing, sudsing, draining, bleaching, rinsing, extracting, repetitions thereof, or combinations thereof.

Flushing can include contacting the laundry item with a flushing composition. In an embodiment, flushing is the initial wetting step in the machine that carries out the washing procedure. A method of cleaning laundry can include flushing one, two, or more times. Conventional flushing compositions are water (e.g., soft or tap water). In conventional systems, flushing can separate loose soil from and wet a laundry item, but little more. Flushing can also be referred to as presoaking, preflushing, or prewashing.

According to the present invention, flushing includes or can be contacting the laundry item with a penetrant composition. In an embodiment, contacting with penetrant composition precedes contact of the laundry item with sudsing and/or bleaching composition. Preferably, contacting with penetrant composition precedes contact of the laundry item with any composition other than water.

Sudsing can include cleaning the laundry item with a sudsing cleaning composition. The sudsing cleaning composition typically includes surfactants and other cleaners, and can include a bleach. Sudsing can follow flushing. According to the present invention, sudsing and other cleaning processes follow contacting with the penetrant composition. In an embodiment, contacting with the penetrant composition can occur during the sudsing cycle, but before addition of sudsing cleaning composition. In an embodiment, sudsing includes contacting a penetrant-treated laundry item with a sudsing cleaning composition.

Draining includes removing a cleaning, flushing, or other composition from the laundry item, for example, by gravity and/or centrifugal force. Draining can follow sudsing. Draining can occur between repeats of flushing.

Bleaching can include cleaning the laundry item with a bleach composition. Bleaching can follow draining and/or sudsing.

Rinsing can include contacting the laundry item with a rinse composition suitable for removing remaining cleaning (sudsing and/or bleach) composition. The rinse composition can, for example, be water (e.g., soft or tap water), a sour rinse, or a rinse including softener. A method of cleaning laundry can include one, two, three, or more rinses. Rinsing can follow bleaching and/or sudsing.

Extracting can include removing a rinse composition from the laundry item, typically with centrifugal force. Extracting can follow one or more rinsings.

Contacting With Penetrant

Contacting with penetrant can include contacting with any of a variety of compositions that effectively penetrate hydrophobic (e.g., oily or greasy) soil on a textile. The penetrant composition can include penetrant plus wetting agent and/or hydrotrope. Suitable penetrant compositions include ingredients such as anionic surfactant (e.g., phosphate ester hydrotrope), alkyl amine oxide, nonionic surfactant (e.g., polyoxyethylene-polyoxypropylene block copolymer), quaternary ammonium compound, solvent, plasticizer, or mixtures thereof.

In an embodiment, the penetrant composition includes nonionic surfactant, alkyl amine oxide, quaternary ammonium compound, or mixture thereof. In an embodiment, the penetrant composition includes a mixture of nonionic surfactant and quaternary ammonium compound or a mixture of alkyl amine oxide and quaternary ammonium compound.

In an embodiment, the penetrant composition includes nonionic surfactant and phosphate ester hydrotrope, or mixture thereof. In an embodiment, the penetrant composition includes a mixture of nonionic surfactant (fast nonionic) with low cloud point and hydrotrope for low-temperature applications.

In an embodiment, the nonionic surfactant includes a low molecular weight nonionic surfactant. Although not limiting to the present invention, it is believed that such nonionics more quickly penetrate hydrophobic soil. Suitable nonionics include ethoxylates of alcohols of about 9 to about 11 carbon atoms with about 4 to about 6 ethoxylates. Additional suitable nonionics include C6–C14 alcohol ethoxylates having 1 to about 8 ethylene oxide groups; C6–C14 alkylphenol ethoxylates (preferably C8–C10 alkylphenol ethoxylates) having 1 to about 8 ethylene oxide groups (or about 12 to about 20 ethylene oxide groups); C6–C14 fatty acid ester ethoxylates, propoxylates or glycerides, and dialkylamine ethoxylates or propoxylates.

Preferred nonionic surfactants for the method of the invention include one or more ethoxylates of alcohols of 9 to 11 carbon atoms and with about 4 ethoxylates or less.

In an embodiment, the alkyl amine oxide includes the coconut or alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide, 3-dodecoxy-2-hydroxypropyldi-(2-hydroxyethyl)amine oxide, isoalkyl dimethyl amine oxide, stearyl dimethyl amine oxide, and octyl dimethyl amine oxide, and dimethyl-alkylamidopropyl amine oxide (lueromine oxide LF from CRODA).

Preferred alkyl amine oxide surfactants for the method of the invention include dimethyl amine oxides, such as decyl dimethyl amine oxide, lauryl dimethyl amine oxide, myristyl dimethyl amine oxide, cetyl dimethyl amine oxide, combinations thereof, and the like.

In an embodiment, the quaternary ammonium compound includes alkyl ethoxylated and/or propoxylated quaternary ammonium salts (or amines). Preferably, the alkyl group contains between about 6 and about 22 carbon atoms and can be saturated and/or unsaturated. The degree of ethoxylation is preferably between about 2 and about 20, and/or the degree of propoxylation is preferably between about 0 and about 30. In an embodiment, the quaternary ammonium compound includes an alkyl group with about 6 to about 22 carbon atoms and a degree of ethoxylation between about 2 and about 20. A preferred cationic surfactant is commercially available under the name Berol 563 from Akzo-Nobel.

In an embodiment, the penetrant composition includes about 10 to about 90 wt-%, about 20 to about 80 wt-%, about 30 to about 70 wt-%, about 40 to about 60 wt-%, or about 45 to about 55 wt-% nonionic surfactant. In an embodiment, the penetrant composition includes about 10 to about 90 wt-%, about 20 to about 80 wt-%, about 30 to about 70 wt-%, about 40 to about 60 wt-%, about 45 to about 55 wt-%, or about 0 wt-% alkyl amine oxide. In an embodiment, the penetrant composition includes about 10 to about 90 wt-%, about 20 to about 80 wt-%, about 30 to about 70 wt-%, about 40 to about 60 wt-%, about 45 to about 55 wt-%, or about 0 wt-% quaternary ammonium compound.

Use compositions of the penetrant composition can be made by, for example, adding the penetrant composition to water with, preferably, mixing or agitation. For forming a use composition, the penetrant concentrate composition can be diluted to about 200 to about 500 ppm, about 100 to about 1000 ppm, about 50 to about 2000 ppm, about 100 to about 300 ppm, about 400 to about 600 ppm, 50 to 600 ppm, or about 200 to about 1200 ppm.

Textile Cleaning

The method of the invention can be used with typical commercial textile cleaning or laundering processes and machines. For example, the present method can include metering into a commercial or tunnel washing machine a useful amount of the penetrant compositions in a flushing cycle or portion of a tunnel washer. The concentration of penetrant composition is typically at about 0.01 to 2 wt % in the aqueous flushing composition in the washer. The textiles or laundry items can be treated at ambient or elevated temperatures. Preferably, the wash temperature is about 5 to about 60° C., about 10 to about 30° C., or about 10 to about 25° C. Contacting with penetrant composition is conducted for sufficient time to effectively penetrate hydrophobic soil, for example, about 10 to about 600 seconds, preferably about 20 to about 300 seconds. Typically, agitation of the composition of the clothing does not substantially improve treatment as long as the hydrophobic soil is penetrated by the aqueous penetrant composition. To promote penetration, the washer load can be agitated mechanically.

After contacting with penetrant, the textile (e.g., laundry item) can be cleaned according to conventional procedures. Preferably, the textile is cleaned with a textile cleaning composition including a built detergent and chlorine bleach in a suds/bleach combination or in two separate wash steps, i.e. suds steps with built detergent followed by bleach step with chlorine.

The present method and composition can be employed for removing any of a variety of hydrophobic (e.g., oily or greasy) soils. Suitable oily or greasy soils include lipstick, makeup, sebum containing soils, dirty motor oil, other mineral oils, organic oils (e.g. olive oil), and the like.

The present method and composition can be employed on any of a variety of textiles. Suitable textiles include cotton, cotton/polyester blend, polyester, and the like.

Penetrant Compositions

The present invention includes penetrant compositions for textile cleaning. In an embodiment, the penetrant composition includes nonionic surfactant, alkyl amine oxide, quaternary ammonium compound, or mixture thereof. In an embodiment, the penetrant composition includes a mixture of nonionic surfactant and quaternary ammonium compound or a mixture of alkyl amine oxide and quaternary ammonium compound.

Nonionic Surfactant

The penetrant composition can include a nonionic surfactant that can effectively penetrate hydrophobic soil on a textile in a time suitable for textile cleaning, such as about 10 to about 600 seconds. Suitable nonionic surfactants include those with ethylene oxide moieties, propylene oxide moieties, as well mixtures thereof. Such nonionic surfactants include alkyl ethylene oxide compounds, alkyl propylene oxide compounds, and mixtures thereof; nonionic surfactants having mixtures or combinations of ethylene oxide-propylene oxide moieties linked to a alkyl chain where the ethylene oxide and propylene oxide moieties can be in any randomized or ordered pattern. Nonionic surfactants useful in the present invention can also include randomized sections of block and heteric ethylene oxide propylene oxide, or ethylene oxide-propylene oxide, such as ethylene diamine ethylene oxides, ethylene diamine propylene oxides, mixtures thereof, and ethylene diamine EO-PO compounds, including those sold under the tradename Tetronic.

The present composition can include alcohol alkoxylate having EO, PO and/or BO blocks. Such alkoxylates are available from several sources including BASF Wyandotte where they are known as "Plurafac" surfactants and including ethylene oxide/propylene oxide derivatives sold under the Pluronic™ trade name. Suitable alcohol alkoxylates include those having the general formula R-$(EO)_m$-$(PO)_n$, wherein n+m is an integer of about 2–8 and R can be any suitable radical such as a straight chain alkyl group having from about 6–14 carbon atoms. Suitable alcohol alkoxylates include ethylene diamine ethylene oxides, ethylene diamine propylene oxides, mixtures thereof, and ethylene diamine EO-PO compounds, including those sold under the tradename Tetronic. Preferably, such surfactants have a molecular weight of about 400. The present composition can include capped aliphatic alcohol alkoxylates. These end caps include but are not limited to methyl, ethyl, propyl, butyl, benzyl and chlorine.

The present composition can include fatty acid alkoxylate, e.g., a fatty acid moiety with an ester group including EO and/or PO. Preferably, the molecular weights of such surfactants are about 400. Preferably, the alkyl group has about 6–14 carbon atoms.

The present composition can include alkyl phenol alkoxylate. Such surfactants can be include an alkyl phenol moiety having an alkyl group with 4 to about 18 carbon atoms and can contain ethylene oxide and/or propylene oxide. Preferably such surfactants have a molecular weight of about 400 and have from about 2 to about 8 units of ethylene oxide, propylene oxide, or mixtures thereof.

In an embodiment, the nonionic surfactant includes a low molecular weight nonionic surfactant. Although not limiting to the present invention, it is believed that such nonionics more quickly penetrate hydrophobic soil. Suitable nonionics include ethoxylates of alcohols of about 9 to about 11 carbon atoms with about 4 to about 6 ethoxylates. Additional suitable nonionics include C6–C14 alcohol ethoxylates having 1 to about 8 ethylene oxide groups; C6–C14 alkylphenol ethoxylates (preferably C8–C10 alkylphenol ethoxylates) having 1 to about 8 ethylene oxide groups (preferably about 12 to about 20 ethylene oxide groups); C6–C14 fatty acid ester ethoxylates, propoxylates or glycerides; and C4–C14 mono or dialkanolamides.

Preferred nonionic surfactants for the method of the invention include one or more ethoxylates of alcohols of 9 to 11 carbon atoms and with about 4 ethoxylates.

Alkyl Amine Oxide

Amine oxides are tertiary amine oxides corresponding to the general formula:

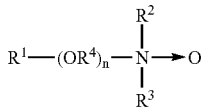

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1–3 carbon atoms or a mixture thereof, $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

In an embodiment, the alkyl amine oxide includes the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide, 3-dodecoxy-2-hydroxypropyldi-(2-hydroxyethyl)amine oxide, isoalkyl dimethyl amine oxide, stearyl dimethyl amine oxide, and octyl dimethyl amine oxide.

Preferred alkyl amine oxide surfactants for the method of the invention include dimethyl amine oxides, such as decyl dimethyl amine oxide, lauryl dimethyl amine oxide, myristyl dimethyl amine oxide, cetyl dimethyl amine oxide, combinations thereof, and the like.

Quaternary Ammonium Compound

Preferred cationic surfactants include quaternary ammonium compounds having the formula:

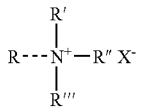

where R, R', R" and R'" are each a $C_1$–$C_{24}$ alkyl, aryl or arylalkyl group that can optionally contain one or more P, O, S or N heteroatoms, and X is F, Cl, Br, I or an alkyl sulfate. Additional preferred cationic surfactants include ethoxylated and/or propoxylated alkyl amines, diamines, or triamines.

Each of R, R', R" and R'" can independently include, individually or in combination, substituents including 6 to 24 carbon atoms, preferably 14 to 24 carbon atoms, and more preferably, 16 to 24 carbon atoms. Each of R, R', R" and R'" can independently be linear, cyclic, branched, saturated, or unsaturated, and can include heteroatoms such as oxygen, phosphorous, sulfur, or nitrogen. Any two of R, R', R" and R'" can form a cyclic group. Any one of three of R, R', R" and R'" can independently can be hydrogen. X is preferably a counter ion and preferably a non-fluoride counter ion. Exemplary counter ions include chloride, bromide, methosulfate, ethosulfate, sulfate, and phosphate.

In an embodiment, the quaternary ammonium compound includes alkyl ethoxylated and/or propoxylated quaternary ammonium salts (or amines). Preferably, the alkyl group contains between about 6 and about 22 carbon atoms and can be saturated and/or unsaturated. The degree of ethoxylation is preferably between about 2 and about 20, and/or the degree of propoxylation is preferably between about 0 and about 30. In an embodiment, the quaternary ammonium compound includes an alkyl group with about 6 to about 22 carbon atoms and a degree of ethoxylation between about 2 and about 20. A preferred cationic surfactant is commercially available under the name Berol 563 from Akzo-Nobel.

Constituent Concentrations

Some examples of representative constituent concentrations for base components of some compositions embodying the invention can be found in Table 1, in which the values are given in wt-% of the ingredients in reference to the total composition weight.

TABLE 1

| Component | wt-% Range | wt-% Range | wt-% Range |
|---|---|---|---|
| nonionic surfactant | 30–70 | 30–70 | 30–60 |
| alkyl amine oxide | 30–70 | | |
| quaternary ammonium compound | | 30–70 | 40–70 |
| additives | | | 5 |

Formulating the Compositions

The compositions of the invention can be formulated, for example, in a liquid, a non-aqueous liquid, a thickened aqueous liquid, or a solid product form. In the liquid formulations, the penetration ingredients of the invention are blended with an aqueous diluent to form a concentrate solution which can then be diluted at a use locus to active levels. The thickened liquid product form can be manufactured in an aqueous diluent with a thickening agent. Similarly, the thickened liquid can be diluted with water to form a use solution which is then used in a laundry machine. Alternatively, the thickened liquid material can be directly contacted with the soiled garment or fabric to treat stains or soils prior to laundering.

The compositions of the invention can be made, for example, by combining the active materials with a solid forming agent or hardening agent. The solid compositions of the invention can then be dispensed from a spray on dispenser as a concentrated use solution which can then be diluted with water prior to use or the concentrate can be directly contacted with the soiled item. Typically, the solid materials of the invention can be prepared by blending the active surfactant ingredients with a solid forming agent under conditions that promote blending of the materials to a uniform composition. The blended composition is then placed into forms or extruded through an appropriately sized die to form the solid treatment compositions.

Additional Components

Solvent

Suitable solvents include N-alkyl pyrrolidones, such as a C8–18 alkyl pyrrolidone (e.g., N-octyl pyrrolidone, N-lauryl pyrrolidone, and the like). Such compounds have the general structure:

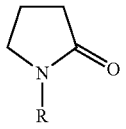

wherein R is a $C_{6-20}$ alkyl or $R_1NHCOR_2$; and R1 is C1–6 alkyl and R2 is C6–20 alkyl. Lauryl (or n-dodecyl) pyrrolidone is commercially available, for example, as sold by ISF Chemicals under the brand name Surfadone, such as Surfadone LP-300.

Solvents of similar structure can also be used. Such solvents include lactones, such as decanolactone. Other suitable solvents include diacetone alcohol, long chain (greater than C6) alkyl ethers, cyclic alkyl ketones, a 1,2 alkane diol having 5 to 10 carbon atoms such as 1,2 hexanediol, a C8–C10 alkene carbonate, a pyrrol (such as N-capryl pyrrol, N-lauryl pyrrol, and the like), and mixtures thereof.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

For laundry cleaning or sanitizing compositions, preferred dyes and odorants include one or more blue dyes, which can be employed at concentrations up to about 0.1 wt-%.

The present invention may be better understood with reference to the following examples. These examples are intended to be representative of specific embodiments of the invention, and are not intended as limiting the scope of the invention.

EXAMPLES

Example 1

Penetrant Compositions Remove Hydrophobic Soil

Textile samples were treated with various penetrant compositions during the operation of a washing machine and before contact with other cleaning compositions. Inventive penetrant compositions demonstrated improved removal of hydrophobic soils.

Materials and Methods

The wash performance tests were conducted for candidate penetrant compositions using a 35# Milnor washer with poly/cotton fill and a swatch set including EMPA 104, Dust/Sebum on poly/cotton (DSP), lipstick, makeup, and dirty motor oil (DMO). The candidate penetrant compositions are listed on Table 1.

The penetrant compositions were injected into the washer during an extended (4 min.) flush cycle before the suds step which used low-temperature (LT) detergent containing a mixture anionic and nonionic surfactants. In two cases, the penetrant composition was injected in the suds bath during fill (last two entries), but before addition of the detergent. Water was added when the water reached the final desired level. Thus, the penetrants had time to work on the soil before the detergent was added. Controls included water alone in the flush or a detergent in the flush.

| Component | Chemical Type |
|---|---|
| Berol 563 | cationic surfactant, quaternary ammonium compound, monoalkyl C6–C22, polyethoxylated (EO of 2 to 20 moles) quaternized amine |
| Berol CHLF | cationic surfactant, quaternary ammonium compound |
| Barlox 12 | amine oxide surfactant, lauryl dimethyl amine oxide |
| Barlox 12i | |
| Tego CQ | mixture of nonionic and quaternary ammonium surfactants |
| Colateric AP | amphoteric surfactant |
| TurboScrub | |
| SandopanDTC | anionic surfactant |
| Berol 260 | |
| Berol 266 | Alcohol ethoxylates $C_9$–$C_{11}$, 4–5.5 ethoxylates |
| Berol 725 | phosphate ester hydrotrope, alcohol ethoxylate phosphate ester |

-continued

| Component | Chemical Type |
|---|---|
| Citroflex A-2 | plasticizer, citric acid ester |
| n-lauryl pyrrol | solvent, analog of alkyl pyrrolidones |

Results

Table 2 presents the results of testing candidate penetrant compositions. Particularly effectiveness was achieved with the mixture of anionic surfactant (e.g., phosphate ester hydrotrope, Berol 260) and cationic surfactant (e.g., quaternary ammonium compound, Berol 563) and with the mixture cationic surfactant (e.g., quaternary ammonium compound, Berol CHLF) and amine oxide surfactant (e.g., lauryl dimethyl amine oxide, Barlox 12).

These penetrant compositions were effective when added either in the extended flush cycle or in the beginning (during fill) of the suds step and before the addition of detergent.

Example 2

Penetrant Compositions Improve Removal of Hydrophobic Soil

Textile samples were treated with several inventive penetrant compositions during the operation of a washing machine and before contact with other cleaning compositions.

Materials and Methods

The wash performance tests were conducted for several penetrant compositions using a 35# Milnor washer with poly/cotton fill and a swatch set generally as described above in Example 1. These penetrant compositions were tested in complete wash cycles including flushing with or without penetrant, followed by sudsing with a built low-temperature detergent with or without penetrant, followed by a bleach step with 100 PPM chlorine at pH 9.

The swatches and penetrant compositions are identified below in Table 3. Each penetrant composition was tested at a concentration of 500 ppm active ingredient.

Results

The results of this experiment are reported in Table 3.

These results demonstrate that each of cationic surfactant (e.g., quaternary ammonium compound, Berol 563 (563 on Table 3)), adducts of this quaternary ammonium compound (e.g., the methyl sulfate adduct (Berol 563MC (563MC on Table 3)) and the methyl chloride adduct (Berol 563SA (563SA on Table 3)), anionic surfactant (e.g., phosphate ester hydrotrope, Berol 260 (260 in Table 3)), and amine oxide surfactant (e.g., lauryl dimethyl amine oxide, Barlox 12 (Bx 12 in Table 3)) provided effective penetrant compositions.

This data indicates particular effectiveness was obtained from the penetrant composition including quaternary ammonium compound methyl sulfate adduct (Berol 563MC (563MC on Table 3)) and amine oxide surfactant (e.g., lauryl dimethyl amine oxide, Barlox 12 (Bx 12 in Table 3)) The amine oxide Barlox 12i, iso-alkyl dimethyl amine oxide surfactant was also effective.

TABLE 2

| Wash Tests | | | | | | | |
|---|---|---|---|---|---|---|---|
| | | % Soil Removal | | | | | |
| Flush | Suds | EMPA 104 | DSP | Lipstick | Makeup | DMO | Average |
| Water | L2000XP | 17.29 | 59.48 | 21.23 | 38.97 | — | 34.24 |
| L2000XP | L2000XP | 15.75 | 66.36 | 28.16 | 27.89 | — | 34.54 |
| Water | LT Detergent | 15.25 | 30.22 | 19.75 | 34.80 | — | 25.01 |
| LT Detergent | LT Detergent | 17.77 | 37.84 | 29.72 | 40.95 | — | 31.57 |
| Berol 563 | LT Detergent | 19.58 | 41.60 | 23.59 | 41.29 | — | 31.52 |
| Berol CHLF | LT Detergent | 22.40 | 38.78 | 19.94 | 40.66 | — | 30.45 |
| Barlox 12 | LT Detergent | 15.23 | 29.40 | 28.46 | 32.96 | — | 26.51 |
| Tego CQ | LT Detergent | 15.68 | 38.31 | 30.61 | 39.75 | — | 31.09 |
| Colateric AP | LT Detergent | 16.95 | 33.44 | 27.45 | 39.78 | — | 29.41 |
| TurboScrub | LT Detergent | 11.15 | 27.83 | 18.13 | 37.95 | — | 23.77 |
| SandopanDTC pH4 250 PPM | LT Detergent | 8.16 | 11.97 | 34.51 | 27.40 | — | 20.51 |
| Berol CHLF/Barlox 12 | LT Detergent | 24.66 | 37.33 | 25.96 | 41.51 | — | 32.36 |
| Berol 260 & 563 | LT Detergent | 19.61 | 33.74 | 30.61 | 40.60 | −5.98 | 31.14 |
| Berol 260 & 725 | LT Detergent | 16.87 | 31.60 | 27.45 | 36.21 | −6.54 | 28.03 |
| Citroflex A-2 | LT Detergent | 16.79 | 31.14 | 18.13 | 40.94 | −4.92 | 26.75 |
| n-lauryl pyrrol | LT Detergent | 13.99 | 25.53 | 25.96 | 42.24 | −1.76 | 26.93 |
| Water | 260 & 563 + LT Detergent | 18.00 | 37.33 | 34.51 | 42.95 | −5.29 | 33.20 |
| Water | CHLF & Bar12 + LT Detergent | 16.07 | 26.80 | 22.04 | 29.60 | — | 23.60 |

TABLE 3

| Wash Tests | | | | | | | |
|---|---|---|---|---|---|---|---|
| | Temperature | | | | | | |
| | 65 F. | 65 F. | 65 F. | 65 F. | 65 F. | 78 F. | 74 F. |
| | Penetrant | | | | | | |
| | None | 563/260 @ 250 PPM in flush | 563/Bx12 @ 250 PPM in flush | 563/260 @ 250 PPM in suds | 563/Bx12 @ 250 PPM in suds | 563MC/Bx12 @ 250 PPM in suds | 563SA/Bx12 @ 250 PPM in suds |
| | Detergent | | | | | | |
| | LT | LT | LT | LT | LT | LT - 88 grams | LT - 88 grams |
| | Bleach | | | | | | |
| | Chlorine | Chlorine | Chlorine | Chlorine | Chlorine | Chlorine | Chlorine |
| Tea | 71.16 | 56.65 | 71.39 | 71.10 | 73.66 | 61.89 | 61.26 |
| Coffee | 88.38 | 91.02 | 89.19 | 88.91 | 89.34 | 88.48 | 88.83 |
| Wine | 74.52 | 78.44 | 72.20 | 74.35 | 74.45 | 76.77 | 73.52 |
| Curry | 54.56 | 52.55 | 55.34 | 53.61 | 53.72 | 53.27 | 51.54 |
| D/S-cotton | 45.43 | 44.91 | 46.00 | 45.64 | 50.22 | 42.56 | 40.88 |
| D/S-poly | 37.59 | 46.55 | 42.89 | 42.47 | 42.04 | 37.24 | 38.17 |
| EMPA 101 | 23.31 | 19.61 | 24.10 | 22.60 | 24.95 | 22.38 | 21.25 |
| EMPA 104 | 22.62 | 24.40 | 27.36 | 26.68 | 29.61 | 29.82 | 27.58 |
| EMPA 106 | 21.12 | 17.65 | 25.33 | 22.08 | 23.60 | 21.37 | 22.75 |
| EMPA 111 | 59.01 | 57.33 | 57.81 | 58.52 | 57.76 | 53.58 | 53.16 |
| EMPA 116 | 31.07 | 29.39 | 31.92 | 27.78 | 26.78 | 26.98 | 28.47 |
| Makeup | 49.79 | 53.63 | 47.91 | 53.30 | 57.32 | 57.04 | 54.01 |
| Lipstick | 34.93 | 36.10 | 39.28 | 31.96 | 40.51 | 45.78 | 41.87 |
| Average | 47.19 | 46.79 | 48.52 | 47.62 | 49.53 | 47.47 | 46.41 |
| Average w/o bleach | 36.10 | 36.62 | 38.07 | 36.78 | 39.20 | 37.41 | 36.46 |

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

We claim:

1. A method for removing soil from a textile, comprising:

providing a penetrant composition;

the penetrant composition consisting of:

about 45 to about 55 wt-% alkyl amine oxide, the alkyl amine oxide being decyl dimethyl amine oxide, lauryl dimethyl amine oxide, myristyl dimethyl amine oxide, cetyl dimethyl amine oxide, or mixtures thereof;

about 45 to about 55 wt-% alkyl ethoxylated quaternary ammonium compound comprising an alkyl group having about 6 to about 22 carbon atoms and a degree of ethoxylation between about 2 and about 20;

optionally, wetting agent, hydrotrope, defoamer, solvent, dye, odorant, or mixture thereof; and diluting the penetrant composition to about 50 to about 2000 ppm in water in a laundry machine;

contacting the soiled textile in the laundry machine with the diluted penetrant composition during flushing or during fill for sudsing and without contacting the laundry with a sudsing or bleaching composition;

washing the penetrant treated textile with a textile cleaning composition; and removing soil from the textile.

2. The method of claim 1, wherein contacting comprises contacting in a tunnel washer.

3. The method of claim 1, wherein contacting comprises contacting during a flush of a commercial washing machine.

4. A method for removing soil from a textile, comprising:

providing a penetrant composition;

the penetrant composition consisting of:

about 45 to about 55 wt-% nonionic surfactant, the nonionic surfactant being an ethoxylate of an alcohol of 9 to 11 carbon atoms and comprising about 4 ethoxylates to about 5.5 ethoxylates;

about 45 to about 55 wt-% alkyl ethoxylated quaternary ammonium compound comprising an alkyl group having about 6 to about 22 carbon atoms and a degree of ethoxylation between about 2 and about 20;

optionally, wetting agent, hydrotrope, defoamer, solvent, dye, odorant, or mixture thereof;

diluting the penetrant composition to about 50 to about 2000 ppm in water in a laundry machine;

contacting the soiled textile in the laundry machine with the diluted penetrant composition during flushing or during fill for sudsing and without contacting the laundry with a sudsing or bleaching composition;

washing the penetrant treated textile with a textile cleaning composition;

removing soil from the textile.

5. The method of claim 1, wherein the textile cleaning composition comprises any built detergent and bleach.

6. The method of claim 1, wherein the soil comprises oily or greasy soil, which comprises mineral oils, organic oils, make up, lipstick, dirty motor oil or mixture thereof.

7. The method of claim 1, wherein the textile comprises cotton, polyester/cotton blend, polyester, spun polyester or mixture thereof.

8. The method of claim 4, wherein contacting comprises contacting in a tunnel washer.

9. The method of claim 4, wherein contacting comprises contacting during a flush of a commercial washing machine.

10. The method of claim 4 wherein the textile cleaning composition comprises built detergent and bleach.

11. The method of claim 4, wherein the soil comprises oily or greasy soil, which comprises mineral oils, organic oils, make up, lipstick, dirty motor oil or mixture thereof.

12. The method of claim 4, wherein the textile comprises cotton, polyester/cotton blend, polyester, spun polyester or mixture thereof.

* * * * *